US008747574B2

(12) United States Patent
Ohishi et al.

(10) Patent No.: US 8,747,574 B2
(45) Date of Patent: Jun. 10, 2014

(54) MARAGING STEEL STRIP

(75) Inventors: Katsuhiko Ohishi, Yasugi (JP); Toshihiro Uehara, Yasugi (JP)

(73) Assignee: Hitachi Metals, Ltd., Tokyo (JP)

( * ) Notice: Subject to any disclaimer, the term of this patent is extended or adjusted under 35 U.S.C. 154(b) by 92 days.

(21) Appl. No.: 13/259,897

(22) PCT Filed: Mar. 25, 2010

(86) PCT No.: PCT/JP2010/055258
§ 371 (c)(1),
(2), (4) Date: Sep. 23, 2011

(87) PCT Pub. No.: WO2010/110379
PCT Pub. Date: Sep. 30, 2010

(65) Prior Publication Data

US 2012/0031529 A1 Feb. 9, 2012

(30) Foreign Application Priority Data

Mar. 26, 2009 (JP) ..... 2009-077409

(51) Int. Cl.
*C22C 38/44* (2006.01)
*C23C 8/26* (2006.01)

(52) U.S. Cl.
USPC ..... 148/318; 148/335; 420/109

(58) Field of Classification Search
USPC ..... 148/316–319, 328, 330, 333–337, 405; 420/94–97, 103–112, 121, 123, 129
See application file for complete search history.

(56) References Cited

U.S. PATENT DOCUMENTS

| | | | |
|---|---|---|---|
| 3,532,491 A | 10/1970 | Floreen et al. | |
| 2001/0006081 A1 | 7/2001 | Uehara et al. | |
| 2002/0059967 A1 | 5/2002 | Coutu | |
| 2004/0003869 A1 | 1/2004 | Ishii et al. | |
| 2010/0189590 A1 * | 7/2010 | Ohishi et al. | 420/84 |

FOREIGN PATENT DOCUMENTS

| | | |
|---|---|---|
| EP | 1 111 080 A2 | 6/2001 |
| EP | 1 291 445 A1 | 3/2003 |
| JP | 10-152759 | 6/1998 |
| JP | 2001-240943 A | 9/2001 |

(Continued)

OTHER PUBLICATIONS

International Search Report for PCT/JP2010/055258, dated Jun. 22, 2010.

(Continued)

*Primary Examiner* — Roy King
*Assistant Examiner* — Vanessa Luk
(74) *Attorney, Agent, or Firm* — Sughrue Mion, PLLC

(57) ABSTRACT

Provided is a maraging steel strip which has such a composition that can reduce the content of TiN acting as the starting point of fatigue fracture in a high-cycle region, and the bending fatigue strength of which has been improved by the precipitation hardening effect yielded by precipitating coherent nitrides in the nitrided structure. A maraging steel strip produced by nitriding a managing steel which contains by mass, C: 0.01% or less, Si: 0.1% or less, Mn: 0.1% or less, P: 0.01% or less, S: 0.005% or less, Ni: 8.0 to 22.0%, Cr: 0.1 to 8.0%, Mo: 2.0 to 10.0%, Co: 2.0 to 20.0%, Ti: 0.1% or less, Al: 2.5% or less, N: 0.03% or less, and O: 0.005% or less, with the balance being Fe and unavoidable impurities, wherein Baker-Nutting orientation relationship with an orientation difference within 10° exists between the Cr nitride precipitated in the nitrided layer and the matrix martensite.

3 Claims, 11 Drawing Sheets

(NOTE) : $\alpha'$ SHOWS MARTENSITE

(56) References Cited

FOREIGN PATENT DOCUMENTS

| | | | |
|---|---|---|---|
| JP | 2002-167652 | A | 6/2002 |
| JP | 2002-302715 | A | 10/2002 |
| JP | 2004-514056 | A | 5/2004 |
| JP | 2006-328486 | A | 12/2006 |
| JP | 2007-186780 | A | 7/2007 |
| JP | 2008-088540 | A | 4/2008 |
| JP | 2008-185183 | A | 8/2008 |
| JP | 2009-013464 | | 1/2009 |
| WO | 2009/008071 | A1 | 1/2009 |

OTHER PUBLICATIONS

Supplementary European Search Report issued in Application No. 10756175.5 dated Aug. 1, 2012.

Mexican Office Action for corresponding Application No. 44509 dated May 15, 2013.

Chechenin et al.; TEM Study of Ti-N and Cr-N Precipitate Formation in Iron Alloys; phys. stat. sol. 177, 117 (2000).

* cited by examiner (NOTE) : $\alpha'$ SHOWS MARTENSITE

MARAGING STEEL STRIP

CROSS REFERENCE TO RELATED APPLICATIONS

This application is a National Stage of International Application No. PCT/JP2010/055258, filed on Mar. 25, 2010, which claims priority from Japanese Patent Application No. 2009-077409, filed Mar. 26, 2009, the contents of all of which are incorporated herein by reference in their entirety.

TECHNICAL FIELD

The invention relates to a maraging steel strip having improved fatigue strength. Particularly, the invention relates to a structural control of a nitrided structure obtained through nitriding treatment of a maraging steel strip for a metallic belt used in continuously variable transmissions for automobiles or the like.

BACKGROUND ART

A maraging steel generally has a very high tensile strength of about 2000 MPa, and thus it has been used for members required to have high strength in various applications, such as rocket parts, centrifugal separator parts, aircraft parts, continuously variable transmission parts of automobile engines, or dies. A typical composition of the maraging steel contains 18% Ni, 8% Co, 5% Mo, 0.4% Ti, 0.1% Al and the balance of Fe.

The maraging steel contains appropriate amounts of Co, Mo and Ti as hardening elements, and can obtain high strength by precipitating intermetallic compounds such as $Ni_3Mo$, $Ni_3Ti$ or $Fe_2Mo$ through aging treatment. In particular, it is an important requirement to have fatigue strength particularly in a high cycle region for a steel strip used for continuously variable transmission parts of automobile engines. Thus, it is required to make nonmetallic inclusions such as TiN, which are included in the maraging steel having the high strength, fine as far as possible. Moreover, the maraging steel has been used by subjecting it to nitriding treatment to form a nitrided layer on its surface to improve fatigue strength.

For example, JP-A-2004-514056 (Patent Literature 1), JP-A-2001-240943 (Patent Literature 2) and JP-A-2002-167652 (Patent Literature 3) proposed improved alloys for avoiding decrease in fatigue strength, which occurs due to a nonmetallic inclusion as a starting point, for metallic belts used for continuously variable transmissions of automobile engines.

The applicant also has proposed improved alloys for avoiding the decrease in fatigue strength occurring due to a nonmetallic inclusion as a starting point, which alloy contains reduced Ti content of 0.1 mass % or less so as to substantially eliminate the inclusions such as TiN, in JP-A-2008-088540 (Patent Literature 4), JP-A-2007-186780 (Patent Literature 5) and WO2009-008071 (Patent Literature 6).

Moreover, JP-A-2008-185183 (Patent Literature 7) has proposed a method for producing a maraging steel strip having high fatigue strength, in which the maraging steels described in the above Patent Literatures 4 to 6 are heated and maintained in a gas atmosphere containing fluorine compounds to remove an oxide film from their surface, and then are subjected to nitriding treatment at a temperature of 400 to 500° C. in a nitriding gas that is controlled to have $NH_3/H_2$ gas composition ratio from 1 to 3.

CITATION LIST

Patent Literature

Patent Literature 1: JP-A-2004-514056
Patent Literature 2: JP-A-2001-240943
Patent Literature 3: JP-A-2002-167652
Patent Literature 4: JP-A-2008-088540
Patent Literature 5: JP-A-2007-186780
Patent Literature 6: WO2009/008071
Patent Literature 7: JP-A-2008-185183

SUMMARY OF THE INVENTION

The alloy disclosed in the above Patent Literature 1 contains reduced Ti content of 0.1% or less since Ti forms nonmetallic inclusions. Therefore, although the alloy is advantageous in terms of including fine TiN acting as a starting point of fatigue fracture, the alloy has a problem of difficulty in nitriding treatment since it simply restrains addition of element which forms nonmetallic inclusions.

The alloy disclosed in Patent Literature 2 also contains a reduced Ti content, and therefore, it is advantageous in terms of making fine TiN acting as a starting point of fatigue fracture. However, the alloy has difficulty in ensuring high tensile strength since a Co content is kept low, that is one of hardening elements. Moreover, Si and Mn are added to ensure the tensile strength. However, they likely decrease toughness.

The alloy disclosed in Patent Literature 3 also contains a reduced Ti content, and therefore, it is advantageous in terms of making fine TiN acting as a starting point of fatigue fracture. However, positive addition of C for increasing strength may lead to precipitation of carbides of Cr, Mo and the like which act as a starting point of fatigue fracture to decrease the fatigue strength, and the positively added C likely deteriorates weldability required for continuously variable transmission parts.

The maraging steels proposed by the applicant in Patent Literatures 4 to 6 are alloys invented to solve problems of the maraging steels proposed in the above Patent Literatures 1 to 3.

In Patent Literature 7, fatigue strength can be further improved by specific nitriding treatment using the maraging steels proposed in Patent Literatures 4 to 6. However, in Patent Literature 7, only temperatures and gas composition ratios for the nitriding treatment are discussed.

Alloy elements in the maraging steels proposed in Patent Literatures 4 to 6 contain Cr and Al, which influence the fatigue strength since precipitation thereof changes during the nitriding treatment and influences on nitriding properties. The present inventors studied in detail a typical nitrided structure of precipitates generated during the nitriding treatment, and the influence thereof on the fatigue strength. As a result, the inventors found that the precipitates generated during the nitriding treatment greatly influence the fatigue strength.

An objective of the invention is to provide a maraging steel strip which has a composition capable of reducing TiN content acting as a starting point of fatigue fracture in a high cycle region, and having an improved bending fatigue strength by optimizing a nitrided structure after the nitriding treatment.

The inventors diligently studied relationship between the nitrided structure of typical a precipitate generated in the nitriding treatment and the fatigue strength with use of the maraging steels proposed in Patent Literatures 4 to 6. As a result of this study, the inventors found that the fatigue strength can be improved by adjusting a structure of Cr nitride formed by the nitriding treatment. This finding leads to the invention.

Thus, the invention provides a maraging steel strip produced by nitriding a maraging steel comprising, by mass %, C: 0.01% or less, Si: 0.1% or less, Mn: 0.1% or less, P: 0.01% or less, S: 0.005% or less, Ni: 8.0 to 22.0%, Cr: 0.1 to 8.0%, Mo: 2.0 to 10.0%, Co: 2.0% to 20.0%, Ti: 0.1% or less, Al: 2.5% or less, N: 0.03% or less, O: 0.005% or less, and the balance being Fe and unavoidable impurities, wherein Cr nitride precipitated in a nitrided layer and martensite matrix have Baker-Nutting orientation relationship with an orientation difference within 10°.

In the invention, one or more of, by mass %, Ca: 0.01% or less, Mg: 0.005% or less, and B: 0.01% or less may be contained in addition to the above elemental composition.

Moreover, in the invention, a maraging steel strip is more advantageous which contains Al less than 0.1%, and Al+Ti is restricted to 0.1% or less.

ADVANTAGES OF INVENTION

According to the invention, TiN acting as a starting point of fatigue fracture can be reduced in the maraging steel, and excellent fatigue property can be obtained after nitriding treatment. Therefore, when the maraging is used for members required to have high fatigue strength, such as a power transmission metallic belt used for continuously variable transmissions for automobiles, it is expected to have an industrially remarkable advantage e.g. of being capable of obtaining long fatigue life.

DETAILED DESCRIPTION OF THE INVENTION

Figure 1:
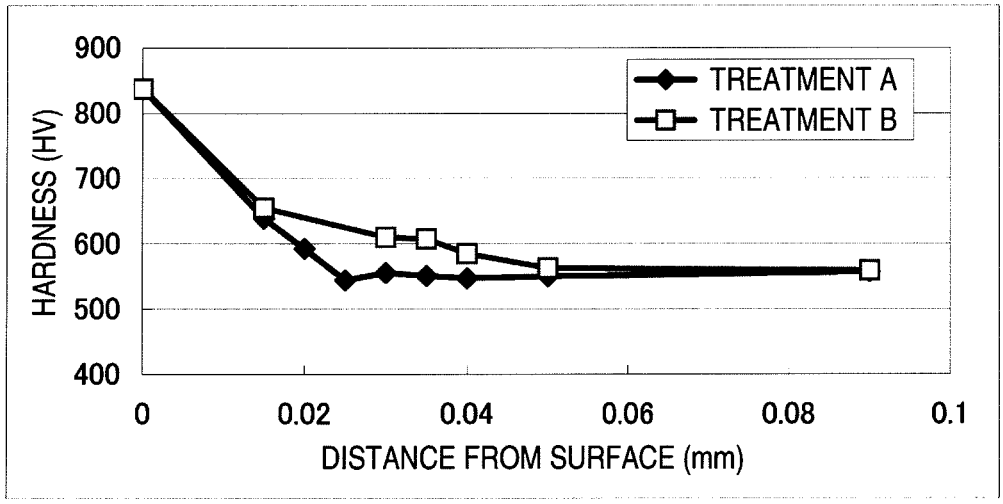
FIG. 1 shows a result of measurements of hardness distribution of maraging steel strips for a metallic belt after nitriding treatment.

The invention has been made based on the above new finding. Hereinafter, effect of each element in the invention will be described.

In a maraging steel of the invention, each chemical element is defined within following range, and the reason therefore is as follows. Please note that contents are described in mass % unless otherwise specified.

Carbon (C) should be kept low since C forms carbides together with Mo to reduce precipitated intermetallic compounds and decrease strength of the steel. Moreover, positive addition of C increases a risk of deteriorating weldability required for e.g. continuously variable transmission parts. For these reasons, a C content is defined to be 0.01% or less. The C content is preferably 0.008% or less.

Silicon (Si) makes intermetallic compounds fine during aging treatment and forms intermetallic compounds with Ni so that the element is capable of compensating for decrease in strength caused by reduction of Ti. However, Si content should be kept low to ensure toughness and ductility of the steel in the invention, since Si possibly decreases the toughness. Si content is defined to be 0.1% or less since addition of Si exceeding 0.1% decreases the toughness and ductility. The Si content is preferably 0.05% or less in order to surely ensure the toughness and ductility.

Manganese (Mn) forms intermetallic compounds with Ni during aging treatment and contributes to age hardening, so that the element is capable of compensating for decrease in strength caused by reduction in Ti. However, Mn content should be kept low to ensure toughness and ductility of the steel in the invention since Mn possibly decreases the toughness. Mn content is defined to be 0.1% or less since addition of Mn exceeding 0.1% decreases the toughness and ductility. The Mn content is preferably 0.05% or less in order to surely ensure the toughness and ductility.

Phosphor (P) and sulfur (S) segregate at old austenite grain boundaries and form inclusions. Thus, they are detrimental elements since they embrittle the maraging steel and decrease fatigue strength thereof. Therefore, P content is defined to be 0.01% or less, and S content is defined to be 0.005% or less. Preferably, the P content is in a range of 0.005% or less, and the S content is 0.004% or less.

Chromium (Cr) decreases a nitriding depth, increases nitriding hardness, and increases compression residual stress of a nitrided surface since the element has strong affinity with nitrogen. Thus, addition of Cr is essential for the steel. However, since Cr content of less than 0.1% does not achieve the effects and the Cr content exceeding 8.0% does not achieve further effects and greatly decrease strength of the steel after aging. Therefore, the Cr content is defined to be 0.1 to 8.0%. The Cr content is preferable more than 0.2% and 4.0% or less.

At least 8.0% of nickel (Ni) is required to stably form a low-C martensitic structure which is a matrix structure of the maraging steel. However, Ni content exceeding 22.0% stabilizes an austenitic structure, and makes it difficult to induce martensite transformation. Thus, the Ni content is defined to be from 8.0 to 22.0%. The preferable range of Ni is more than 17.0% and 22.0% or less.

Molybdenum (Mo) is an important element for the steel since the element forms fine intermetallic compounds such as $Ni_3Mo$ and $Fe_2Mo$ during aging treatment and contributes to precipitation hardening. Moreover, Mo is effective for increasing surface hardness and compression residual stress due to nitriding. Mo content of less than 2.0% makes tensile strength of the steel insufficient, and Mo content exceeding 10.0% facilitates formation of coarse intermetallic compounds composed mainly of Fe and Mo. Thus, the Mo content is defined to be from 2.0 to 10.0%. The preferable range of Mo is more than 3.0% and 7.0% or less.

Cobalt (Co) is an important element since it promotes precipitation of fine intermetallic compounds containing Mo and Al, and contributes to aging precipitation hardening. Co increases degree of solid solution of aging precipitate-forming elements such as Mo and Al at a solid solution treatment temperature, and decreases degree of solid solution of Mo and Al at an aging precipitation temperature, without exerting a great influence on stability of a martensitic structure of the matrix of the steel. Although much Co content is necessary to be added from a viewpoint of strength and toughness, if the Co content is less than 2.0%, the maraging steel having reduced Si, Mn and Ti has difficulty in obtaining sufficient strength. On the other hand, if the Co content exceeds 20.0, Co makes austenite stable to make it difficult to obtain a martensitic structure. Thus, the Co content is defined to be more than 2.0% and 20.0% or less. Preferable range of Co is more than 4.0% and 20.0% or less.

In a case of limiting aluminum (Al), it is preferable that cobalt (Co) content is slightly increased since Al contributing to strengthening of the steel is decreased. Therefore, the Co content ranges more than 10.0% and 20.0% or less.

Titanium (Ti) is one of essential elements for hardening the maraging steel. However, Ti is a detrimental element at the same time since it forms inclusions such as TiN or Ti(C, N), thereby decreases fatigue strength of the steel particularly in an ultra-high cycle region. Therefore, in a case of placing importance on the fatigue strength, Ti is necessary to be kept low as an impurity level.

Ti tends to form a thin and stable oxide film on a surface of the steel. The oxide film hinders nitriding reaction, and therefore makes it difficult to obtain a sufficient compression residual stress on a nitrided surface. Ti is a detrimental impurity element, and the content thereof is necessary to be kept low in order to facilitate nitriding and to increase the compression residual stress on the surface after nitriding.

Ti content is defined to be 0.1% or less since Ti content of more than 0.1% does not produce sufficient effect of reducing TiN or Ti(C, N), and facilitates formation of the stable oxide film on the surface of the steel. The Ti content is preferably 0.05% or less, and further preferably 0.01% or less.

Regarding aluminum (Al), there are two cases in the invention: one is positive addition of Al; and the other is restriction thereof.

The positive addition of Al may improve strength of the maraging steel. Therefore, when importance is placed on the strength, Al is preferably added.

Al is usually added in a small amount for deoxidation, and essentially forms intermetallic compounds with Ni during aging treatment and contributes to strengthening. Since the maraging steel for a metallic belt of the invention has reduced Si, Mn and Ti, Al may compensate strength. Moreover, an effect may be also expected that a good nitrided layer is obtained by facilitating nitriding treatment in the maraging steel with reduced Ti.

However, Al content of more than 2.5% is not preferable since much AlN and $Al_2O_3$ inclusions are formed to decrease fatigue strength, or a thin and stable oxide film is formed on a surface of the steel to hinder nitriding reaction. When Al is added positively, surface roughness of the maraging steel can be somewhat increased. Therefore, preferable upper limit of positively added Al is 1.5%.

On the other hand, when the content of Al is restricted, nonmetallic inclusions in the maraging steel may be reduced. Further, surface roughness of the maraging steel is influenced by Al and can be easily kept flat. Therefore, when importance is placed on fatigue strength, it is preferable to restrict Al. According to a study conducted by the inventors, specific nitrided structure is effective in further improving fatigue strength which has been improved by lowing Al. For purpose of increasing the fatigue strength, Al content is preferably restricted to less than 0.1%, and more preferably to 0.05% or less.

Moreover, it is effective to keep total amount of Al and Ti low to improve the fatigue strength since both of Al and Ti form nonmetallic inclusions. Therefore, it is desirable that a total amount of Al and Ti (Al+Ti) is 0.1% or less. The preferable range of the Al+Ti content is 0.07% or less.

Nitrogen (N) is an impurity element that is combined with Ti to form inclusions of TiN or Ti(C, N) and decreases fatigue strength particularly in ultra-high cycle region. For a maraging steel containing Ti, content of N is necessary to be kept significantly low to prevent formation of coarse TiN or Ti(C, N). However, for a maraging steel scarcely containing Ti, the N content is defined to be 0.03% or less since an amount of N mixed in usual vacuum melting exerts a little adverse influence. Desirably, the N content is 0.01% or less. Further desirably, the N content is 0.005% or less.

Oxygen (O) is an impurity element that forms oxide-based inclusions and thereby decreases toughness and fatigue strength of the steel. Therefore, content of O is restricted to 0.005% or less. Desirably, the O content is 0.003% or less.

In the invention, one or more of Ca: 0.01% or less, Mg: 0.005% or less, and B: 0.01% or less is contained.

An ingot of the maraging steel of the invention may be produced by melting in a vacuum atmosphere, such as by vacuum induction melting or by vacuum induction melting followed by vacuum arc remelting or electroslag remelting. However, even when such melting in the vacuum atmosphere is performed, it is technically difficult to completely eliminate nonmetallic inclusions.

Since the steel of the invention may contain Al to improve strength of the steel, there are risks of formation of coarse and hard $Al_2O_3$ inclusions exceeding e.g. 25 μm, or of occurrence of clustered $Al_2O_3$. The $Al_2O_3$ inclusions have high hardness and high melting point, and are scarcely deformed, e.g., even during hot plastic working. Thereby, they may generate a flaw on a roll e.g. during cold rolling so that surface defect may be generated on the maraging steel for a metallic belt. Therefore, it is preferable that the $Al_2O_3$ inclusions be made composite inclusions combined with other oxides to decrease hardness and lower melting point thereof. Moreover, an element capable of preventing occurrence of the cluster is preferably added for preventing inclusion defects.

Silicon (Si), manganese (Mn), calcium (Ca) and magnesium (Mg) are raised as the effective elements for making $Al_2O_3$ composite inclusions. In the invention, amounts of addition of Si and Mn are restricted since Si and Mn reduces toughness and ductility. Therefore, one or more of Ca and Mg other than Si and Mn may be added in the steel to make the $Al_2O_3$ inclusions be composite inclusions. Ca and Mg also have an effect of preventing occurrence of cluster of $Al_2O_3$ inclusions. Therefore, the steel of the invention contains Ca: 0.01% or less and/or Mg: 0.005% or less.

To surely achieve the effects of Ca and Mg, the lower limit of content may be preferably 0.001% for Ca and 0.0001% for Mg.

Boron (B) is an element that makes old austenitic grains fine at the time of solid solution treatment after cold working and contributes to strengthening. B further has an effect of restraining roughness of a surface of the steel. Therefore, B may be optionally added. B content is define to be 0.01% or less since the B content of more than 0.01% decreases toughness of the steel. The B content is desirably 0.005% or less. The preferable lower limit of the B content capable of surely making the old austenitic grains fine is 0.0002%.

The balance other than the above described elements may be iron (Fe) and unavoidable impurities.

However, the steel may contain following element in following range for the purpose of deoxidation, desulfurization and the like.

Zirconium (Zr)≤0.01%

As described above, the maraging steel strip of the invention has an important advantage in that the maraging steel strip is adjusted to have an unconventional nitrided structure in which a substantial Baker-Nutting orientation relationship exists between Cr nitride and matrix martensite after nitriding treatment. Such a specific nitrided structure realizes further improvement of fatigue properties.

The Baker-Nutting orientation relationship herein means that the nitrided structure and the matrix of the invention satisfy following relationships, $$(001)_{CrN}//(001)_{\alpha'}, \text{ and}$$

$$[110]_{CrN}[110]_{\alpha'}.$$

This will be explained in detail hereinafter.

The inventors found that the slight change in a nitriding treatment condition for a maraging steel strip containing Cr led to significantly improved fatigue strength, and pursued causes thereof. As a result, the inventors found that, in nitriding treatment, Baker-Nutting orientation relationship may be established between chromium nitride (CrN) precipitated on a surface of a maraging steel strip containing Cr and a matrix, and then the steel may have significantly improved fatigue strength due to precipitation hardening effect. Since this relationship tends to be very easily disrupted due to a variation of the nitriding condition, it is required to carefully select the condition depending on steel grade.

In the invention, it is defined that the Cr nitride and the matrix martensite satisfy Baker-Nutting orientation relationship with an orientation difference within 10°, in order to specifically represent that substantial Baker-Nutting orientation relationship exists between the Cr nitride and the matrix martensite. When the orientation difference of the orientation relationship is larger than 10°, the precipitation hardening effect can not be expected.

The maraging steel of the invention scarcely contains Ti since Ti forms on the surface of the steel a stable oxide film having a possibility of hindering nitriding. Therefore, it can be easily subjected to various types of nitriding treatment, such as usual gas nitriding, gas nitrocarburizing, nitrosulphurizing, ion nitriding, and salt bath nitriding.

In order to realize the above nitrided structure in the invention, an appropriate solid solution treatment temperature is also important in addition to the composition of the maraging steel strip and the nitriding condition as described above. In the invention, the solid solution treatment temperature is increased to 850 to 950° C. to increase solid solubility of Cr in the alloy. This is because solid solubility of Cr tends to be insufficient when the solid solution treatment temperature is less than 850° C., and this makes it difficult to obtain the nitrided structure defined in the invention. On the other hand, when the solid solution treatment temperature is more than 950° C., grain coarsening occurs. Therefore, the solid solution treatment temperature is defined to be from 850 to 950° C.

Nitriding treatment temperature may range from 450 to 500° C., e.g., in the case of gas nitrocarburizing. Treating time is particularly important. The nitrided structure is sensitive to the treating time. The nitriding treatment temperature particularly changes since the various types of nitriding treatment may be applied as the nitriding treatment as described above. Therefore, it is preferred to check a nitrided structure by changing the treating time, after high temperature solid solution treatment, in order to obtain the nitrided structure of the invention in mass production.

In the maraging steel for a metallic belt to which the above maraging steel strip of the invention is applied, absolute value of compression residual stress of a nitrided layer may be increased by Cr and Al that have an effect of enhancing the nitriding hardness and the absolute value of compression residual stress of the nitrided layer, although the compression residual stress tends to decrease.

The maraging steel strip for a metallic belt of the invention has a high tensile strength and fatigue strength, and is suitable for a metallic belt for a continuously variable transmission of automobile engines since it has excellent fatigue properties through the nitriding treatment.

EXAMPLES

The invention will be explained in more detail with reference to following Examples.

Example 1

Maraging steel having a composition defined in the invention was melted in a vacuum induction melting furnace to produce an ingot of 10 kg, and the ingot was subjected to homogenizing anneal, and then hot forged. Further, steel strips having a thickness of about 0.2 mm were produced by hot rolling and cold rolling, thereby maraging steels for a metallic belt were produced. The chemical composition thereof is shown in Table 1.

Thereafter, the steel strip was subjected to solid solution treatment at 900° C., and further, aging treatment at 490° C. As nitriding treatment, gas nitrocarburizing was performed under conditions at 460° C. for 35 minutes as treatment A, and at 460° C. for 50 minutes as treatment B for clearly representing the change of a nitrided structure. The solid solution treatment was performed in a hydrogen atmosphere.

TABLE 1

| No. | Chemical composition (mass %) | | | | | | | | | | |
|---|---|---|---|---|---|---|---|---|---|---|---|
| 1 | C | Si | Mn | P | S | Cr | Ni | Mo | Co | Ti | Al |
| | 0.003 | 0.01 | 0.01 | 0.003 | 0.001 | 0.97 | 19.3 | 5.1 | 12.8 | 0.01 | 0.03 |
| | N | O | Mg | Ca | B | balance | | | | | |
| | 0.0006 | 0.0018 | 0.0019 | — | 0.0015 | Fe and unavoidable impurities | | | | | |

Note:
Symbol "—" shows no addition.

FIG. 1 shows a result of measurements of hardness distribution obtained by the treatments A and B.

A longitudinal cross sections of the maraging steel strips for a metallic belt after nitriding treatments were embedded in a thermosetting resin and subjected to mirror polishing, and then the hardness distribution was measured with a micro Vickers hardness meter under a load of 50 g. Surface hardness was measured from surfaces of the maraging steel strips with the micro Vickers hardness meter under a load of 100 g. These show that nitriding depths of Nos. 1 and 2 are 25 μm and 50 μm, respectively.

For observation of the nitrided structure, a thin film at a location from about 15 to 20 μm in nitriding depth was produced with a Focus Ion Beam device, and subjected to transmission electron microscope observation. The observation was performed using an electron accelerated with 200 kV. An electron diffraction pattern of a precipitate and a matrix and a stereo analytical method thereof were used for identification of the precipitate and calculation of orientation relationship.

While fatigue tests include various stress modes such as rotational bending, tension/compression and torsion, a suitable evaluation method is one that applies bending stress since the maraging steel of the invention has a form of a strip. Thus, it will be apparent that the maraging steel has high fatigue strength unless fracture occurs when applying such a high stress that fractures a conventional maraging steel in repeated bending fatigue test. Therefore, the repeated bending fatigue test was performed until a number of cycles reached $10^7$ cycles when a repeated bending stress was applied at an average stress of 617 MPa and a maximum stress of 1176 MPa.

Figure 2:
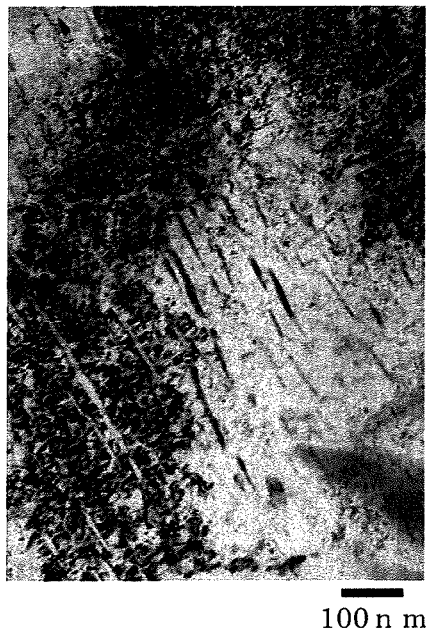
FIG. 2 shows a bright-field image of a nitrided structure obtained through transmission electron microscope observation of No. 1 after treatment A of the invention.
Figure 3:
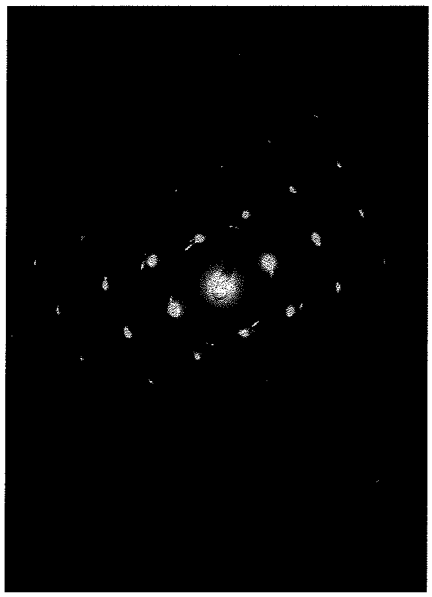
FIG. 3 shows an electron diffraction pattern from a precipitate and a matrix of No. 1 after treatment A of the invention.
Figure 4:
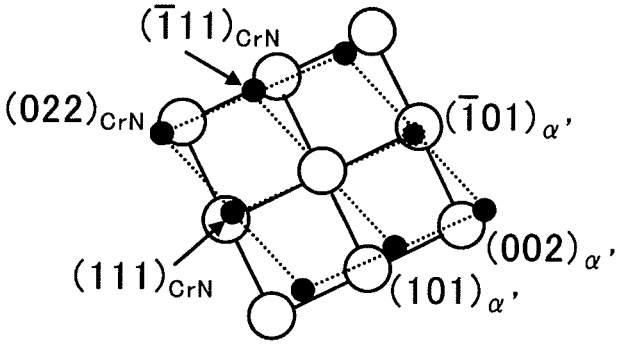
FIG. 4 shows a schematic diagram of the electron diffraction pattern in FIG. 3.
Figure 5:
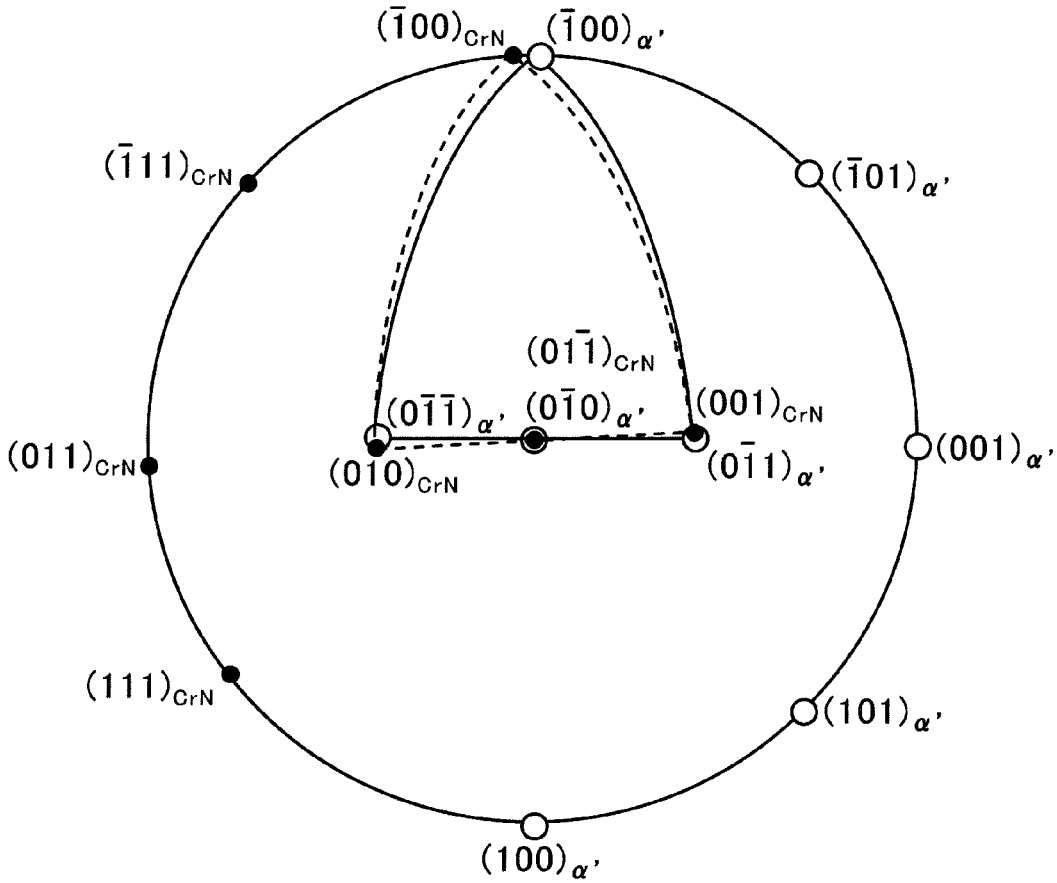
FIG. 5 shows a stereographic projection calculated from the electron diffraction pattern in FIG. 3.

From FIG. 2, a plurality of acicular precipitates were observed in a bright-field image of the treatment A, and found that they have the same orientation. Moreover, it was found that these acicular precipitates were CrN from an analysis of electron diffraction patterns in FIGS. 3 and 4, and that CrN and matrix martensite satisfy Baker-Nutting orientation relationship since they are parallel, $(-100)_{CrN}//(-100)_{\alpha'}$, and $[010]_{CrN}//[0\text{-}1\text{-}1]_{\alpha'}$, with an orientation difference of 4° from stereo analysis in FIG. 5. Thus, good lattice coherence was found.

Figure 6:
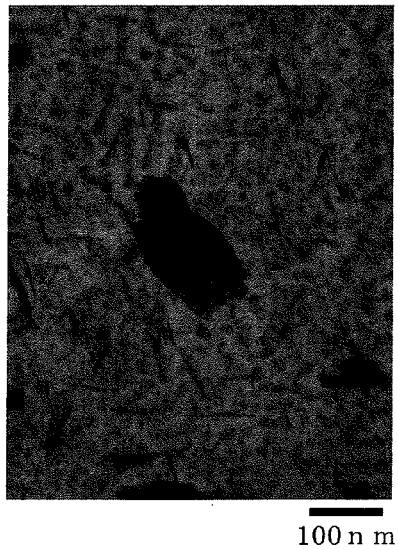
FIG. 6 shows a bright-field image of a nitrided structure obtained through transmission electron microscope observation of No. 1 after treatment B of a comparative example.
Figure 7:
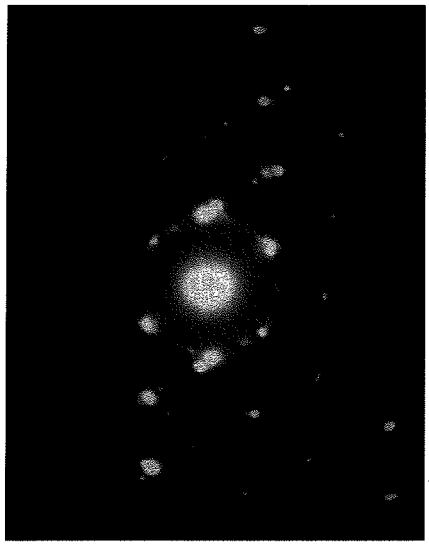
FIG. 7 shows an electron diffraction pattern obtained from a precipitate and a matrix of No. 1 after treatment B of the comparative example.
Figure 8:
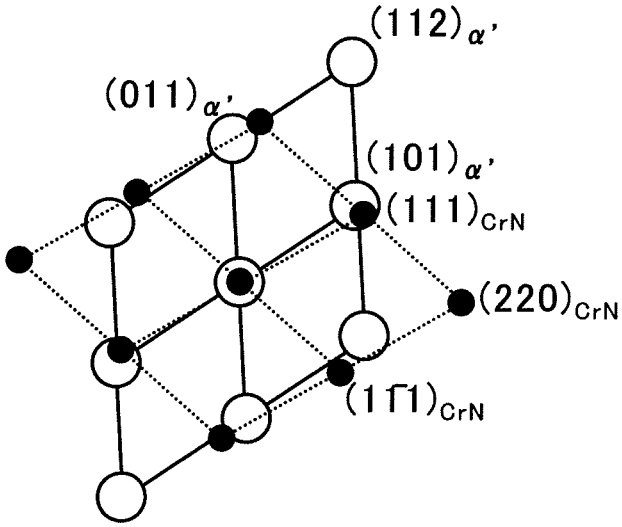
FIG. 8 shows a schematic diagram of the electron diffraction pattern in FIG. 7.
Figure 9:
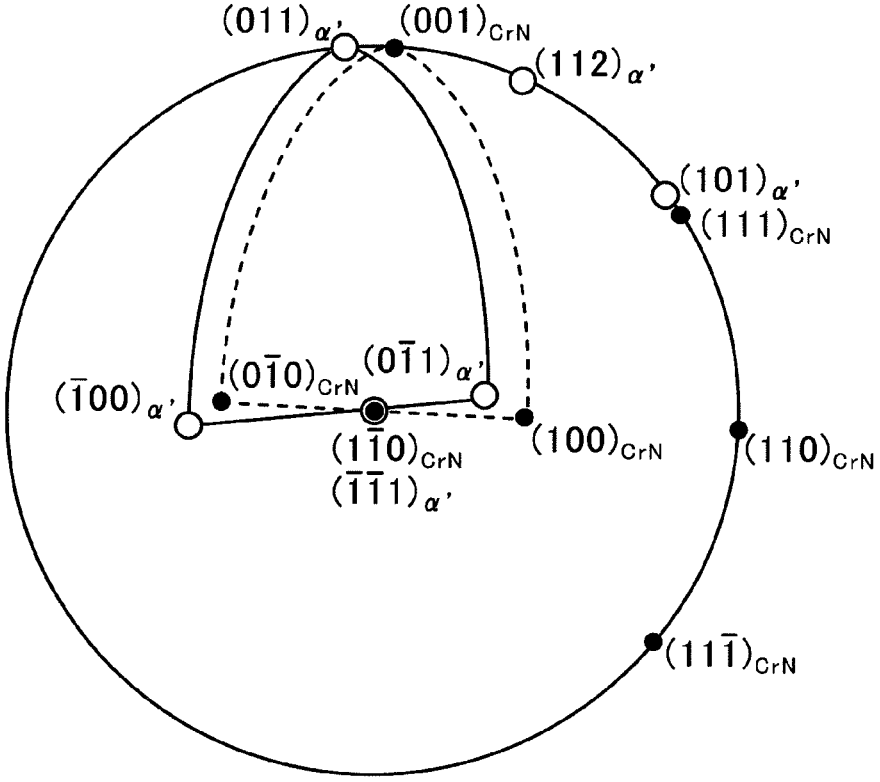
FIG. 9 shows a stereographic projection calculated from the electron diffraction pattern in FIG. 7.

On the other hand, from FIG. 6, a plurality of acicular precipitates were also observed in a bright-field image of the treatment B. However, they were coarser than the precipitates observed in the treatment A. Moreover, it was found that these acicular precipitates were CrN from an analysis of electron diffraction patterns in FIGS. 7 and 8, and a deviation from Baker-Nutting orientation with an orientation difference of 14° was recognized between CrN and matrix martensite from a result of stereo analysis in FIG. 9. Thus, poor lattice coherence was found.

Table 2 shows a result of repeat bending test. This shows that No. 1 maraging steel for a metallic belt with coherent CrN precipitated in a nitrided structure did not fracture until $10^7$ cycles in the repeat bending test under maximum stress of 1176 MPa. On the other hand, all of No. 2 maraging steels fractured at $10^6$ cycles. Therefore, No. 1 after treatment A with the lattice coherent CrN precipitates have excellent fatigue property by the precipitation hardening effect.

Thus, the maraging steel strip of the invention may realize high fatigue strength by optimizing the nitrided structure.

TABLE 2

| Alloy No. | Treatment | Nitriding depth (μm) | Number of cycles until failure (cycles) |
|---|---|---|---|
| 1 | A | 25 μm | $10^7$ (No failure) |
| | | | $10^7$ (No failure) |
| | B | 50 μm | 1268800 |
| | | | 2773500 |

Note:
Fatigue test was performed at maximum stress of 1176 MPa, and at average stress of 617 MPa

Example 2

In Example 2, effect of composition was investigated.

Nos. 2 to 4 maraging steels having composition ranges according to the invention and No. 5 maraging steel which was a comparative material having a conventional composition were melted in a vacuum induction melting furnace to produce ingots of 10 kg, and the ingots were subjected to homogenizing anneal, and then hot forged. Further, steel strips each having a thickness of about 0.2 mm were produced by hot rolling and cold rolling. thus, maraging steels for a metallic belt were produced. Their chemical compositions are shown in Table 3.

TABLE 3

| No. | Chemical composition (mass %) | | | | | | | | | | |
|---|---|---|---|---|---|---|---|---|---|---|---|
| 2 | C | Si | Mn | P | S | Cr | Ni | Mo | Co | Ti | Al |
| | 0.003 | 0.01 | 0.01 | 0.001 | 0.001 | 0.47 | 18.7 | 5.0 | 12.5 | 0.001 | 0.04 |
| | N | O | Mg | Ca | B | balance | | | | | |
| | 0.0008 | 0.0107 | — | — | — | Fe and unavoidable impurities | | | | | |
| 3 | C | Si | Mn | P | S | Cr | Ni | Mo | Co | Ti | Al |
| | 0.003 | 0.01 | 0.01 | 0.002 | 0.002 | 1.43 | 19.1 | 5.1 | 12.4 | 0.001 | 0.03 |

TABLE 3-continued

| No. | Chemical composition (mass %) | | | | | | | | | | |
|---|---|---|---|---|---|---|---|---|---|---|---|
| | N | O | Mg | Ca | B | balance | | | | | |
| | 0.0005 | 0.0017 | 0.0024 | — | 0.0012 | Fe and unavoidable impurities | | | | | |
| 4 | C | Si | Mn | P | S | Cr | Ni | Mo | Co | Ti | Al |
| | 0.004 | 0.01 | 0.01 | 0.003 | 0.001 | 0.94 | 19.0 | 5.0 | 10.0 | 0.001 | 0.49 |
| | N | O | Mg | Ca | B | balance | | | | | |
| | 0.0003 | 0.0005 | 0.0028 | 0.0002 | 0.0013 | Fe and unavoidable impurities | | | | | |
| 5 | C | Si | Mn | P | S | Cr | Ni | Mo | Co | Ti | Al |
| | 0.004 | 0.01 | 0.01 | 0.001 | 0.001 | — | 18.6 | 5.1 | 9.4 | 0.49 | 0.11 |
| | N | O | Mg | Ca | B | balance | | | | | |
| | 0.0004 | 0.0021 | 0.0020 | — | 0.0001 | Fe and unavoidable impurities | | | | | |

Note:
Symbol "—" shows no addition.

The above maraging steels for a metallic belt Nos. 1 to 4 were subjected to solid solution treatment at 900° C., and the steel No. 5 was subjected to solid solution treatment at 850° C. Further, the steels were subjected to aging treatment at 490° C., and thereafter nitrocarburizing under a condition at 460° C. for 40 minutes as treatment C. The solid solution treatment was performed in a hydrogen atmosphere.

For observation of nitrided structure, a thin film at a location from about 15 to 20 μm in nitriding depth was produced with a Focus Ion Beam device, and subjected to transmission electron microscope observation. The observation was performed using an electron accelerated with 200 kV. An electron diffraction pattern of a precipitate and a matrix and a stereo analytical method thereof were used for identification of the precipitate and calculation of orientation relationship. The identification of the precipitate and the orientation relationship were performed with respect to Nos. 2, 3 and 4 of the invention.

Figure 10:
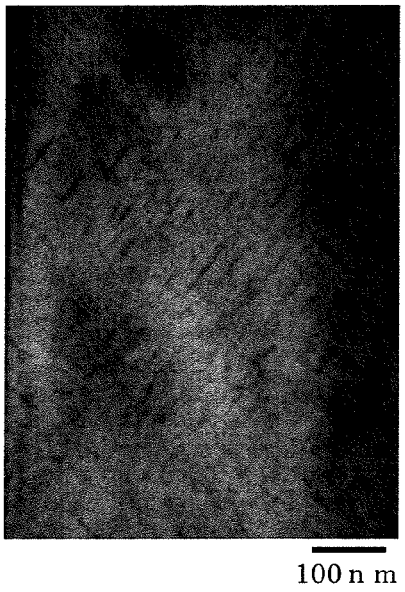
FIG. 10 shows a bright-field image of a nitrided structure obtained through transmission electron microscope observation of No. 2 after treatment C of the invention.
Figure 11:
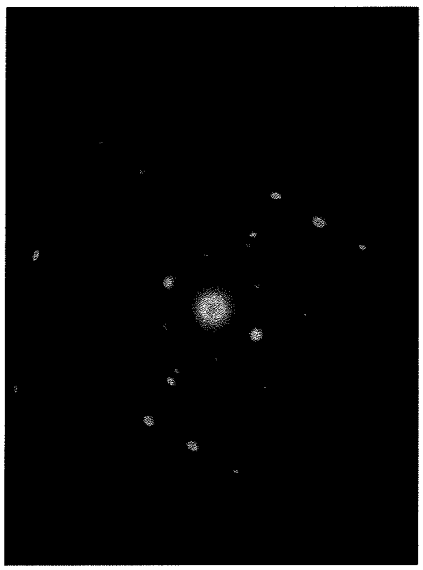
FIG. 11 shows an electron diffraction pattern obtained from a precipitate and a matrix of No. 2 after treatment C of the invention.
Figure 12:
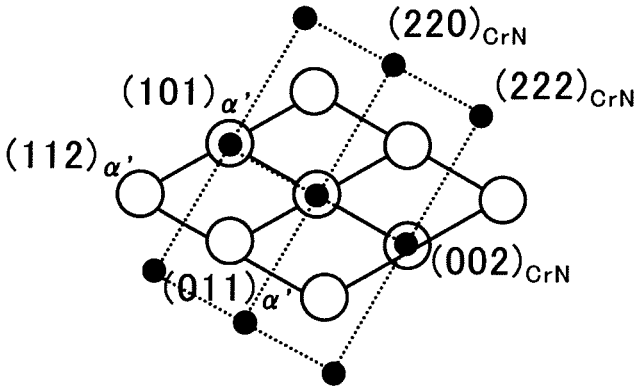
FIG. 12 shows a schematic diagram of the electron diffraction pattern in FIG. 11.

FIG. 10 shows a bright-field image of the steel No. 2. A plurality of acicular precipitates were observed in a bright-field image of the steel No. 2 after treatment C, and they have the same orientation. Moreover, it was found that all of these acicular precipitates were CrN from an analysis of electron diffraction pattern in FIG. 11.

Figure 13:
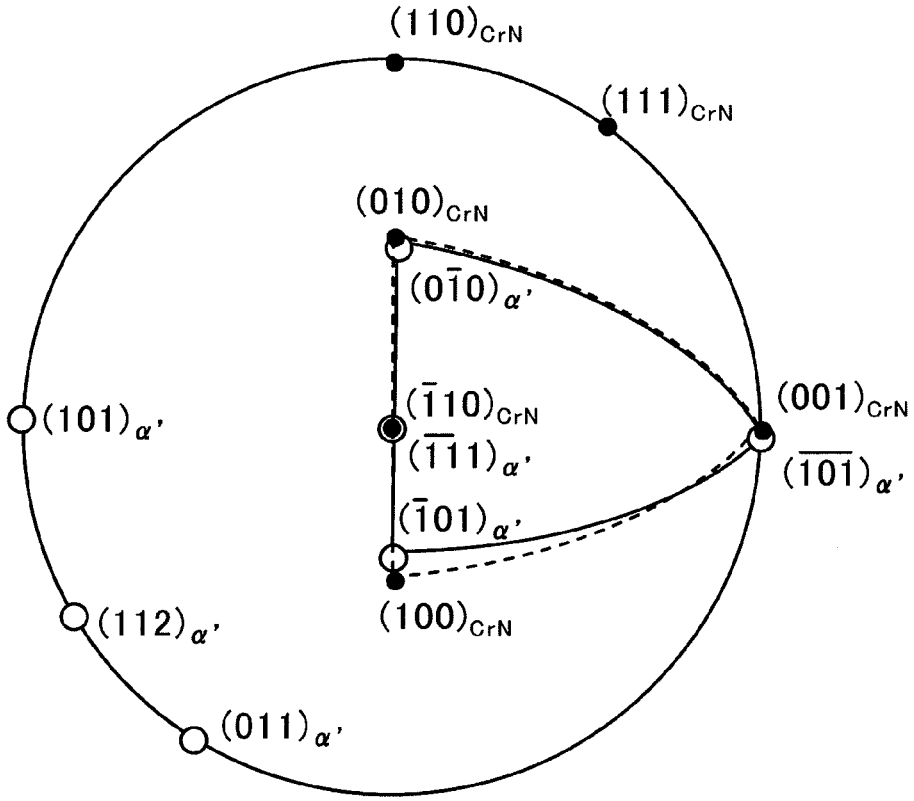
FIG. 13 shows a stereographic projection calculated from the electron diffraction pattern in FIG. 11.

Baker-Nutting orientation relationship was investigated with stereo analysis in FIG. 13. CrN and matrix martensite satisfy the Baker-Nutting orientation relationship since they are in parallel relationships, $(100)_{CrN}//(-101)_{\alpha'}$, and $[010]_{CrN}//[0\text{-}10]_{\alpha'}$, with an orientation difference of 6°. Thus, good lattice coherence was found.

Figure 14:
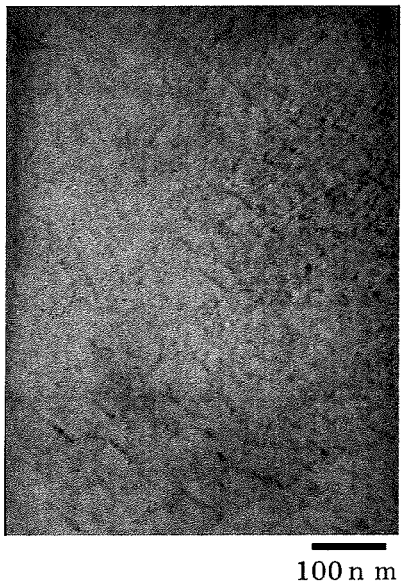
FIG. 14 shows a bright-field image of a nitrided structure obtained through transmission electron microscope observation of No. 3 after treatment C of the invention.
Figure 15:
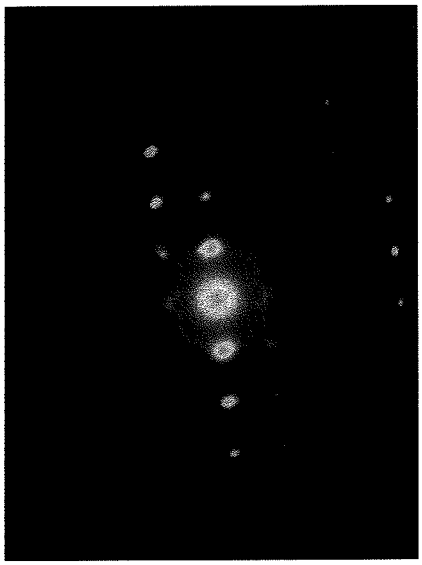
FIG. 15 shows an electron diffraction pattern obtained from a precipitate and a matrix of No. 3 after treatment C of the invention.
Figure 16:
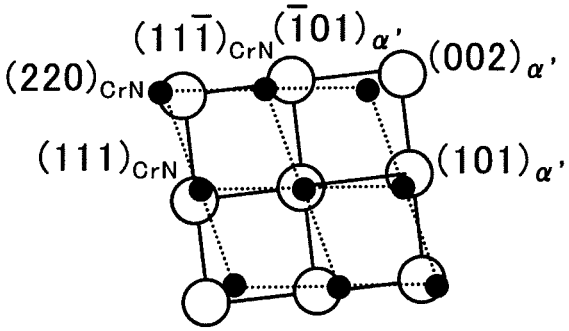
FIG. 16 shows a schematic diagram of the electron diffraction pattern in FIG. 15.

FIG. 14 shows a bright-field image of the steel No. 3. A plurality of acicular precipitates were observed in a bright-field image of No. 3 after treatment C, and found that they have the same orientation. Moreover, all of the acicular precipitates were CrN from an analysis of electron diffraction patterns in FIGS. 15 and 16.

Figure 17:
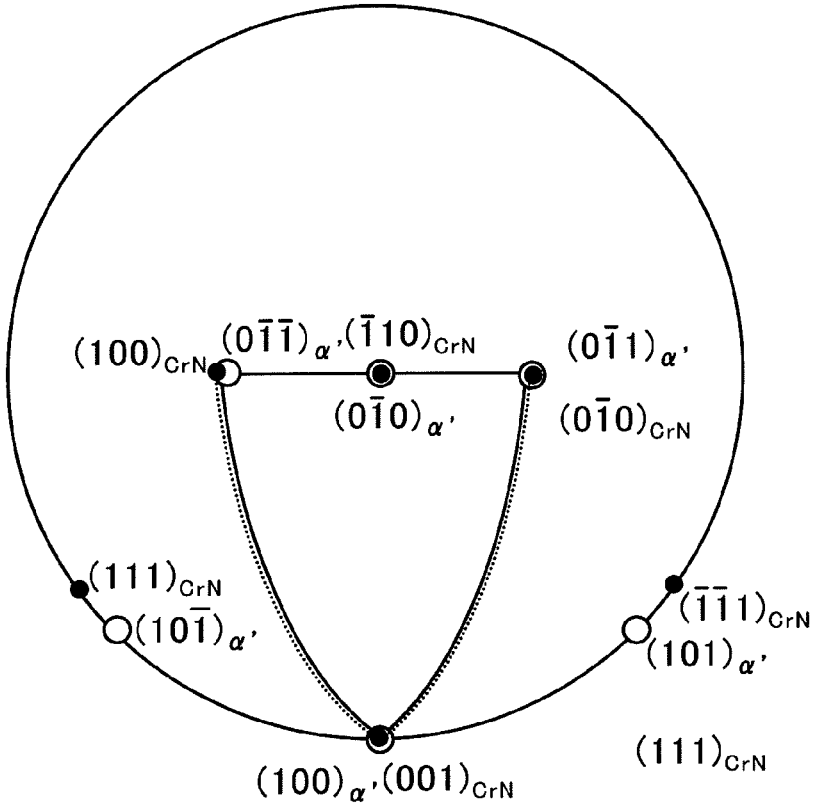
FIG. 17 shows a stereographic projection calculated from the electron diffraction pattern in FIG. 15.

Baker-Nutting orientation relationship was investigated with stereo analysis in FIG. 17. CrN and matrix martensite satisfy the Baker-Nutting orientation relationship since they are in parallel relationships, $(100)_{CrN}//(-1\text{-}1)_{\alpha'}$, and $[0\text{-}10]_{CrN}//[0\text{-}11]_{\alpha'}$, with an orientation difference of 2°. Thus, good lattice coherence was found.

Figure 18:
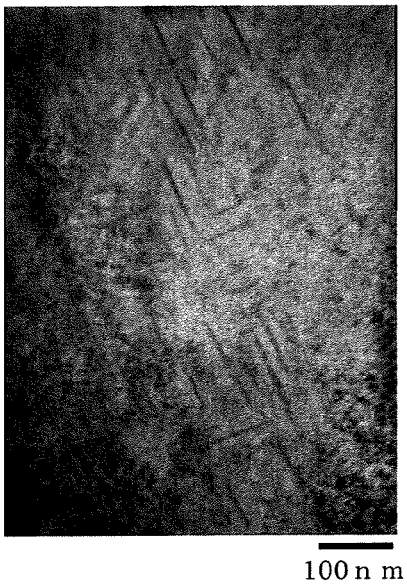
FIG. 18 shows a bright-field image of a nitrided structure obtained through transmission electron microscope observation of No. 4 after treatment C of the invention.
Figure 19:
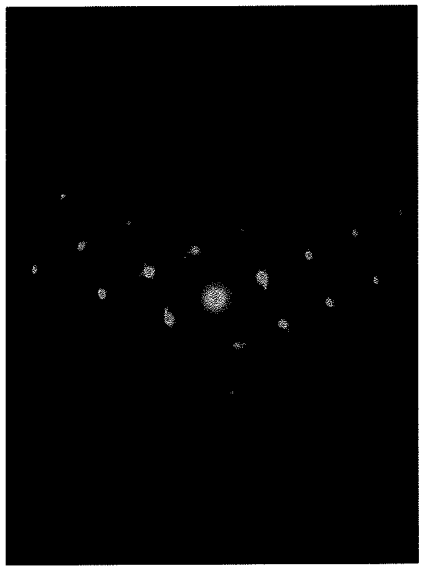
FIG. 19 shows an electron diffraction pattern obtained from a precipitate and a matrix of No. 4 after treatment C of the invention.
Figure 20:
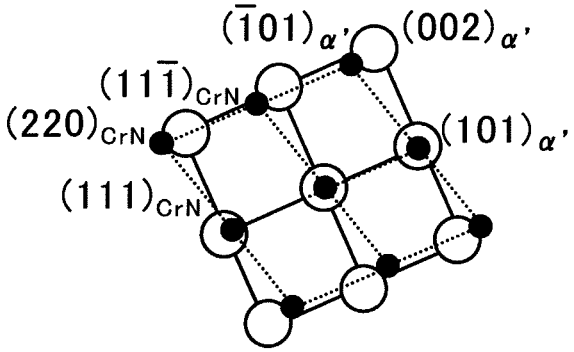
FIG. 20 shows a schematic diagram of the electron diffraction pattern in FIG. 19.

FIG. 18 shows a bright-field image of the steel No. 4. A plurality of acicular precipitates were observed in a bright-field image of No. 4 after treatment C, and found that they are directed in the same orientation. Moreover, all of the acicular precipitates were CrN from an analysis of electron diffraction patterns in FIGS. 19 and 20.

Figure 21:
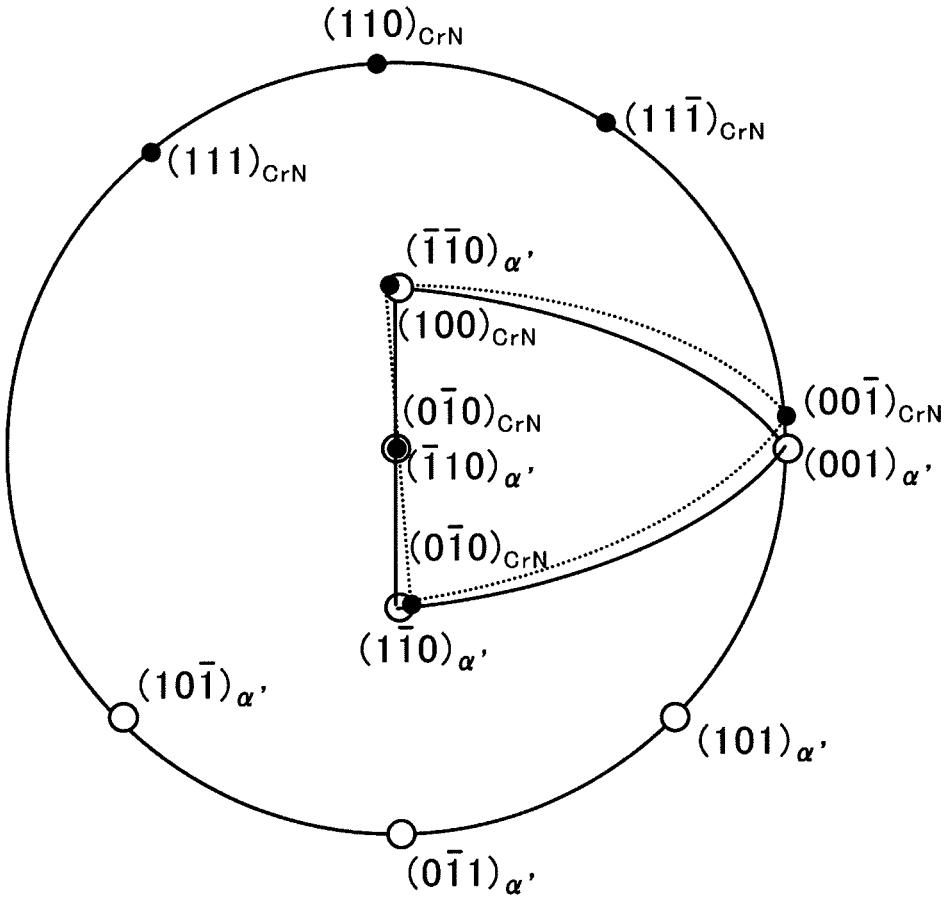
FIG. 21 shows a stereographic projection calculated from the electron diffraction pattern in FIG. 19.

Baker-Nutting orientation relationship was investigated with stereo analysis in FIG. 21. CrN and matrix martensite satisfy the Baker-Nutting orientation relationship since they are in parallel relationships, $(100)_{CrN}//(-1\text{-}10)_{\alpha'}$, and $[0\text{-}10]_{CrN}//[1\text{-}10]_{\alpha'}$, with an orientation difference of 5°. Thus, good lattice coherence was found.

Fatigue test was performed by the repeat bending test in the same manner as Example 1. However, the repeat bending test was performed under a higher stress, that is an average stress of 729 MPa and a maximum stress of 1399 MPa, so as to ensure occurrence of fracture in the maraging steel strip. At this time, the maraging steel strip of the invention of No. 1 after treatment A in the above Example 1 was also subjected to the repeat bending test. Table 4 shows a result of the repeat bending tests.

It was confirmed from Table 4 that the maraging steels for a metallic belt of Nos. 1, 2, 3 and 4 of the invention with the coherent CrN precipitates in the nitrided structure had excellent fatigue property due to the precipitation hardening effect, compared with the comparative steel No. 5 which does not CrN precipitates.

Among them, the maraging steel strips having low Al were found to obtain high fatigue strength regardless of the repeat bending test under a high stress condition.

TABLE 4

| Alloy No. | Treatment | Number of cycles until failure (cycles) | Remarks |
|---|---|---|---|
| 1 | A | 348700<br>352800 | The invention |
| 2 | C | 1004500<br>1330900 | The invention |
| 3 | C | 299800<br>448000 | The invention |
| 4 | C | 78700<br>210500 | The invention |
| 5 | C | 47400<br>93900 | Comparative example |

Note:
Fatigue test was performed at maximum stress of 1399 MPa, and at average stress of 729 MPa.

Each fractured surface of Nos. 1 to 4 maraging steel strips in Table 4 was observed after the fatigue test. The fracture was not starting from inclusions such as TiN and Ti(C, N) but occurred due to surface defect created in the test.

Accordingly, it is found that the maraging steel strip of the invention can improve bending fatigue strength by optimizing the nitrided structure after nitriding treatment.

Industrial Applicability

The maraging steel strip of the invention can be used for a metallic belt used under stringent conditions, and therefore can be applied to members required to have high tensile strength and high fatigue strength, such as a power transmission metallic belt used in continuously variable transmissions for automobiles and the like.

The invention claimed is:

1. A maraging steel strip produced by nitriding a maraging steel comprising, by mass %, C: 0.01% or less,
Si: 0.1% or less,
Mn: 0.1% or less,
P: 0.01% or less,
S: 0.005% or less,
Ni: 8.0 to 22.0%,
Cr: 0.1 to 8.0%,
Mo: 2.0 to 10.0%,
Co: 2.0% to 20.0%,
Ti: 0.1% or less,
Al: 2.5% or less,
N: 0.03% or less,
O: 0.005% or less, and
the balance being Fe and unavoidable impurities,
wherein the steel comprises a nitrided layer on a surface of the steel, the nitrided layer comprising Cr nitride precipitated in the nitrided layer and matrix martensite, and wherein the Cr nitride and the matrix martensite satisfy Baker-Nutting orientation relationship with an orientation difference within 10°.

2. The maraging steel strip according to claim 1, wherein the maraging steel further containing one or more of, by mass %, Ca: 0.01% or less, Mg: 0.005% or less, and B: 0.01% or less.

3. The maraging steel strip according to claim 1, wherein the maraging steel contains less than 0.1% of Al and a total amount of Al and Ti is 0.1% or less.

* * * * *